United States Patent [19]

Dennis

[11] Patent Number: 4,640,374

[45] Date of Patent: Feb. 3, 1987

[54] ROTARY DRILL BIT

[75] Inventor: Mahlon D. Dennis, Kingwood, Tex.

[73] Assignee: Strata Bit Corporation, Houston, Tex.

[21] Appl. No.: 771,877

[22] Filed: Sep. 3, 1985

Related U.S. Application Data

[63] Continuation-in-part of Ser. No. 575,398, Jan. 30, 1984, Pat. No. 4,538,691.

[51] Int. Cl.[4] ..... E21B 10/04; E21B 10/60

[52] U.S. Cl. ..... 175/393; 175/330; 175/404

[58] Field of Search ..... 175/393, 329, 330, 404, 175/418, 415, 413, 410

[56] References Cited

U.S. PATENT DOCUMENTS

| | | | |
|---|---|---|---|
| 1,836,638 | 12/1931 | Wright et al. | 175/333 |
| 2,199,692 | 5/1940 | Catland | 175/393 |
| 2,358,052 | 9/1944 | Brown | 175/418 |
| 2,575,826 | 11/1951 | Mecom | 175/415 |
| 2,931,630 | 4/1960 | Grady | 175/329 |
| 3,199,617 | 8/1965 | White | 175/404 |
| 3,548,959 | 12/1970 | Hasiba | 175/393 |
| 3,727,704 | 4/1973 | Abplanalp | 175/329 |
| 4,207,954 | 6/1980 | Jerome | 175/330 |
| 4,234,048 | 11/1980 | Rowley | 175/329 |
| 4,499,795 | 2/1985 | Radtke | 175/329 |
| 4,505,342 | 3/1985 | Barr et al. | 175/329 |

FOREIGN PATENT DOCUMENTS

| | | | |
|---|---|---|---|
| 1366118 | 6/1964 | France | 175/329 |
| 237071 | 11/1969 | U.S.S.R. | 175/329 |
| 711267 | 1/1980 | U.S.S.R. | 175/393 |
| 825833 | 4/1981 | U.S.S.R. | 175/393 |

*Primary Examiner*—James A. Leppink
*Assistant Examiner*—Hoang C. Dang
*Attorney, Agent, or Firm*—Burns, Doane, Swecker & Mathis

[57] ABSTRACT

A rotary drill bit includes a cutting face having a peripheral edge and a central recess. A plurality of fluid discharge nozzles are mounted in bores in the cutting face. A plurality of cutter elements are mounted in the peripheral edge and in the recess to fracture an earthen core formed as the drill cuts through a formation. A plurality of lateral discharge passages extend radially through the bit body from said recess and extend longitudinally to the peripheral edge to form circumferential interruptions in the peripheral edge. Each passage includes leading and trailing edges at the cutting face. A convex protrusion is disposed centrally at a longitudinally inner end of the recess and includes a convex deflecting surface arranged to contact and fracture the earthen core and deflect the cuttings to the lateral discharge passages. The outer periphery of the cutting face is radially recessed to accommodate the flow of drilling fluid. The cutting face includes a groove extending from one side of the outer end of each nozzle bore and terminating at the nearest one of the trailing edges to conduct debris from the bore to the nearest discharge passage.

5 Claims, 8 Drawing Figures

Fig. 4
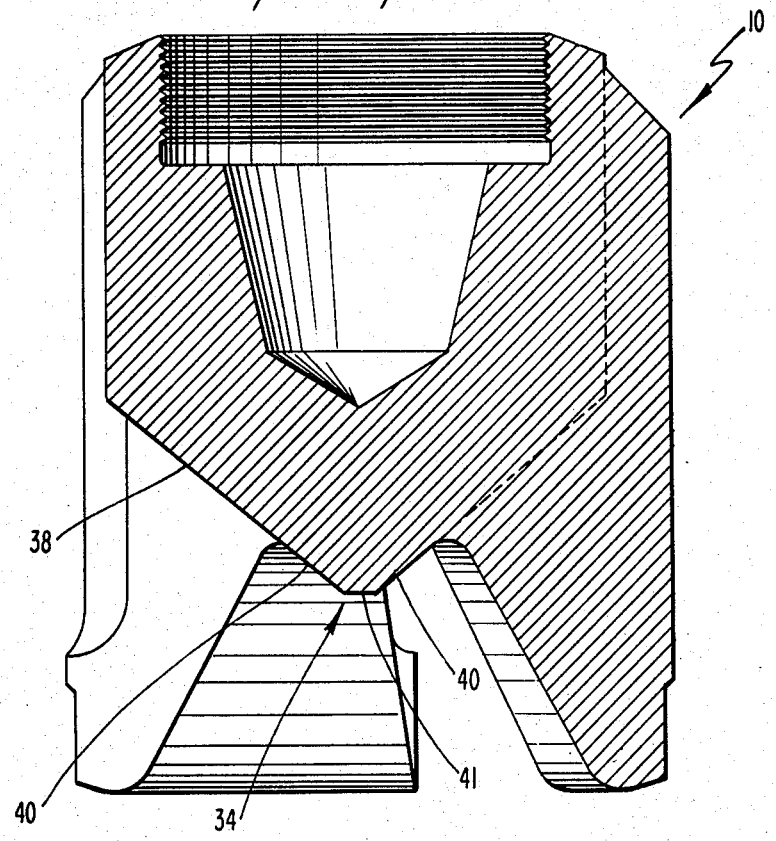
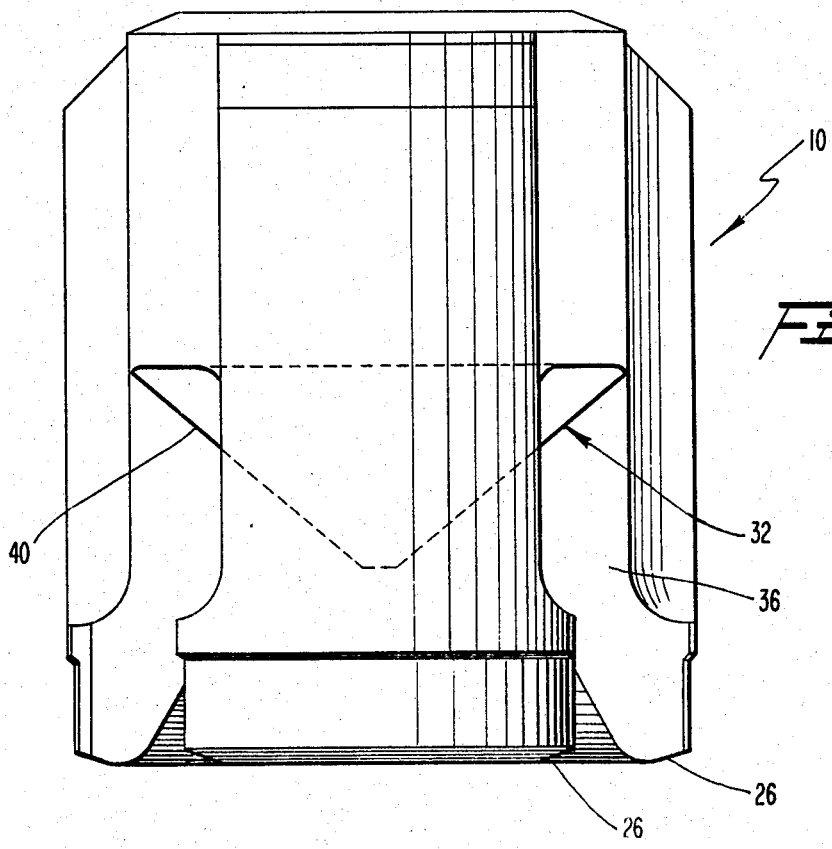
Fig. 5

ROTARY DRILL BIT

RELATED INVENTIONS

This is a Continuation-in-Part of U.S. application Ser. No. 06/575,398 filed Jan. 30, 1984, now U.S. Pat. No. 4,538,691 issued Sept. 3, 1985.

BACKGROUND AND OBJECTS OF THE INVENTION

The present invention relates to drill bits for use in rotary drilling through earth formations.

In a typical rotary drilling operation, a rotary drill bit is rotated while being advanced into a soil or rock formation. The soil or rock is cut by cutting elements on the drill bit, and these cuttings are flushed from the borehole by the circulation of drilling fluid toward the top of the borehole. The drilling fluid is delivered to the drill bit downwardly through a passage in the drill stem and is ejected outwardly through nozzles disposed in bores in the cutting face of the drill bit. The ejected drilling fluid is directed outwardly through the nozzles at high speed to aid in cutting, and to flush the cuttings and cool the cutter elements.

A traditional area of concern in the design of rotary drill bits of this type involves the configuration at the center of rotation of the bit cutting face where the linear speed of the cutter elements is relatively slow.

It has been heretofore proposed to provide a drill bit with a concave recess at the center of the cutting face. When cutting through a hard substance, a core of the substance is formed within the recess. The core is gradually broken up by cutter elements disposed within the recess and/or by an inclined surface disposed at an inner end of the recess. The inclined surface also deflects the cuttings laterally through a discharge passage in the bit body. A drill bit of that type has utility in the cutting of both hard and soft substances. In the latter, the lateral discharge passage promotes the discharge of a high volume of cuttings which might otherwise clog-up the recess; thus, cutting may proceed at a faster rate. Exemplary of drill bits of that type are the bits disclosed in Grady U.S. Pat. No. 2,931,630 issued Apr. 5, 1960; Abplanalp U.S. Pat. No. 3,727,704 issued Apr. 17, 1973; and Rowley U.S. Pat. No. 4,234,048 issued Nov. 18, 1980.

Drill bits of the above-described type are subject to certain shortcomings, however, as determined by the present inventor. For example, as the core is engaged and broken up by the inclined surface at the inner end of the recess, an unbalanced force pattern is established on the drill bit. That is, the force generated by the contact between core and the inclined surface includes a radial component which tends to displace the drill bit from its intended travel path. As a result, it becomes difficult to cut in a predetermined straight path.

Furthermore, in cases where the discharge passage in the bit body extends longitudinally all the way to the forward end of the bit, there may be a tendency for drilling fluid to bypass some of the cutting elements mounted on the bit. That is, such a discharge passage forms a convenient travel path for drilling fluid to travel directly from the nozzle to the annulus without contacting the cutter bits to flush and cool same.

An additional problem involves an inability of the drilling fluid to flow freely along the outermost periphery of the drill face. As a result, the drilling fluid may not flush the cuttings along that outer periphery. When that occurs, the cuttings can build-up in that region to the point where proper functioning of the drill is obstructed.

Yet another problem relates to the possibility that chunks of debris may become lodged within one or more of the bores in which the nozzles are mounted. If that occurs, the fluid ejected from the nozzle(s) may be deflected back against the drilling face, producing cavitation thereof.

It is, therefore, an object of the present invention to minimize or obviate problems of the above-described sort.

Another object is to provide a drill bit which has utility in hard and soft substances and which promotes drilling in a straight direction.

A further object is to provide such a drill bit which minimizes tendencies for drilling fluid to bypass the cutter elements.

An additional object is to provide a centrally recessed drill bit which fractures a core without generating appreciable unbalanced forces on the bit.

A further object is to provide such a drill with a dam that deflects drilling fluid toward cutter elements which otherwise would be bypassed.

An additional object is to facilitate the free flow of drilling fluid along the outer periphery of the drilling face to avoid a build-up of cuttings in that region.

A further object is to resist any tendency for chunks of debris to become lodged within the nozzle bores.

SUMMARY OF THE INVENTION

These objects are achieved by the present invention which relates to a rotary drill bit for cutting in earth formations. The drill bit comprises a bit body which includes a cutting face having a peripheral edge and a central recess extending longitudinally inwardly from the peripheral edge. A plurality of fluid discharge nozzles are mounted in the cutting face for emitting drilling fluid under pressure. A plurality of cutter elements are provided. Some of the cutter elements are mounted in the peripheral edge, and others of the cutter elements are mounted in the recess to fracture an earthen core formed as the drill cuts through the formation. A plurality of lateral discharge passages are formed in the bit body. The passages extend radially through the body from the recess and also extend longitudinally to the peripheral edge to form circumferential interruptions in the peripheral edge. A convex protrusion is disposed centrally at a longitudinally inner end of the recess. The protrusion defines a convex deflecting surface which is arranged to contact and fracture the earthen core and deflect the cuttings to the lateral discharge passages.

As a result of such an arrangement, the engagement of the earthen core with the protrusion creates a generally balanced pattern of forces against the drill bit which do not tend to divert the drill bit from its intended path of travel.

Ridges formed of a hard material are disposed along trailing edges of the discharge passages. Each ridge projects from the cutting face by a distance less than that of the cutter elements and is arranged to retard the flow of drilling fluid into the associated discharge passage from an adjacent nozzle whereby such fluid is caused to flow across cutter elements located behind the ridge. In this fashion, the ridge prevents the fluid from bypassing the cutter elements; rather, the fluid contacts the cutter elements to flush and cool same.

The outer peripheral edge of the cutting face is radially recessed relative to the gauge surface to accommodate the flow of drilling fluid and thereby assure that the drilling fluid flushes cuttings from the region of such peripheral edge.

The nozzles are mounted in bores formed in the cutting face. The discharge passages include leading and trailing edges at the cutting face. The cutting face includes a groove extending from one side of an outer end of each bore and terminating at the nearest discharge passage for conducting cuttings from the bore to that discharge passage.

THE DRAWINGS

The objects and advantages of the invention will become apparent from the following detailed description of a preferred embodiment thereof in connection with the accompanying drawings in which like numerals designate like elements, and in which:

FIG. 4 is a longitudinal sectional view through the drill bit taken along line 4—4 of FIG. 2, with the nozzles and cutter elements being omitted for clarity;

FIG. 5 is a side elevational view of the drill bit taken along line 5—5 of FIG. 2, with the nozzles and cutting elements being omitted for clarity.

DETAILED DESCRIPTION OF A PREFERRED EMBODIMENT OF THE INVENTION

Figure 1:
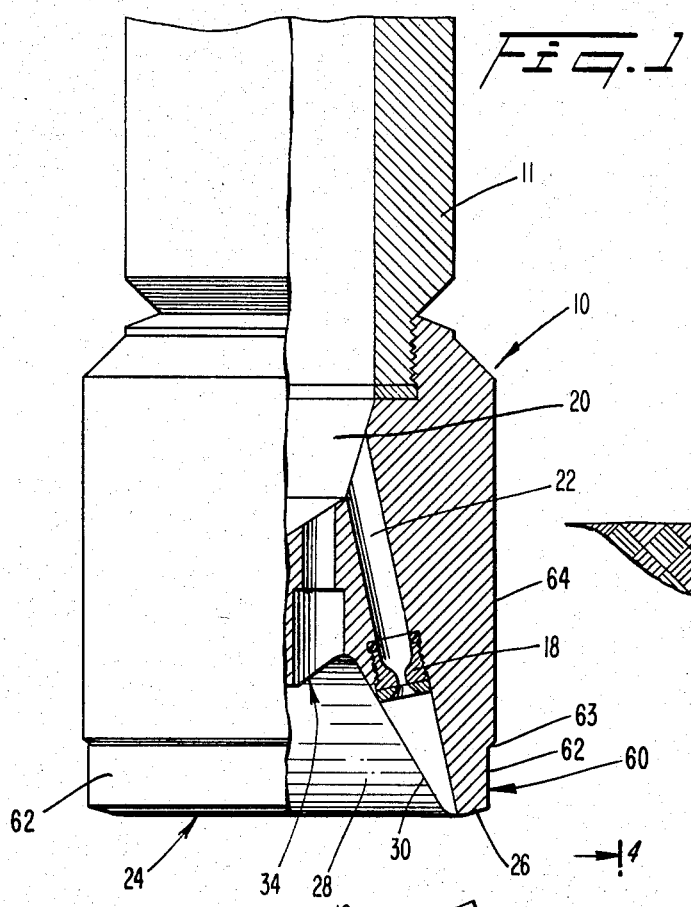
FIG. 1 is a side elevational view, partially in longitudinal section, of a drill bit and a drill string according to the present invention.
Figure 3:
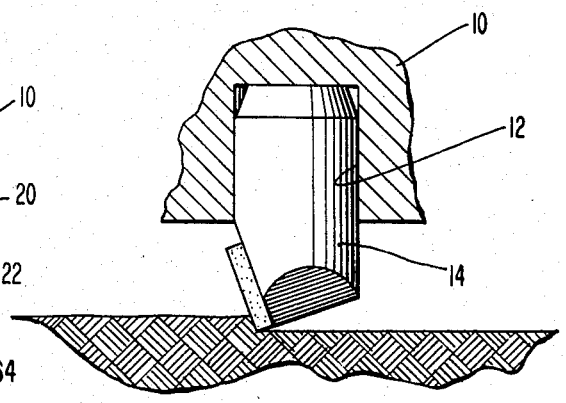
FIG. 3 is a side elevational view of a cutter element employed in the drill bit.
Figure 2:
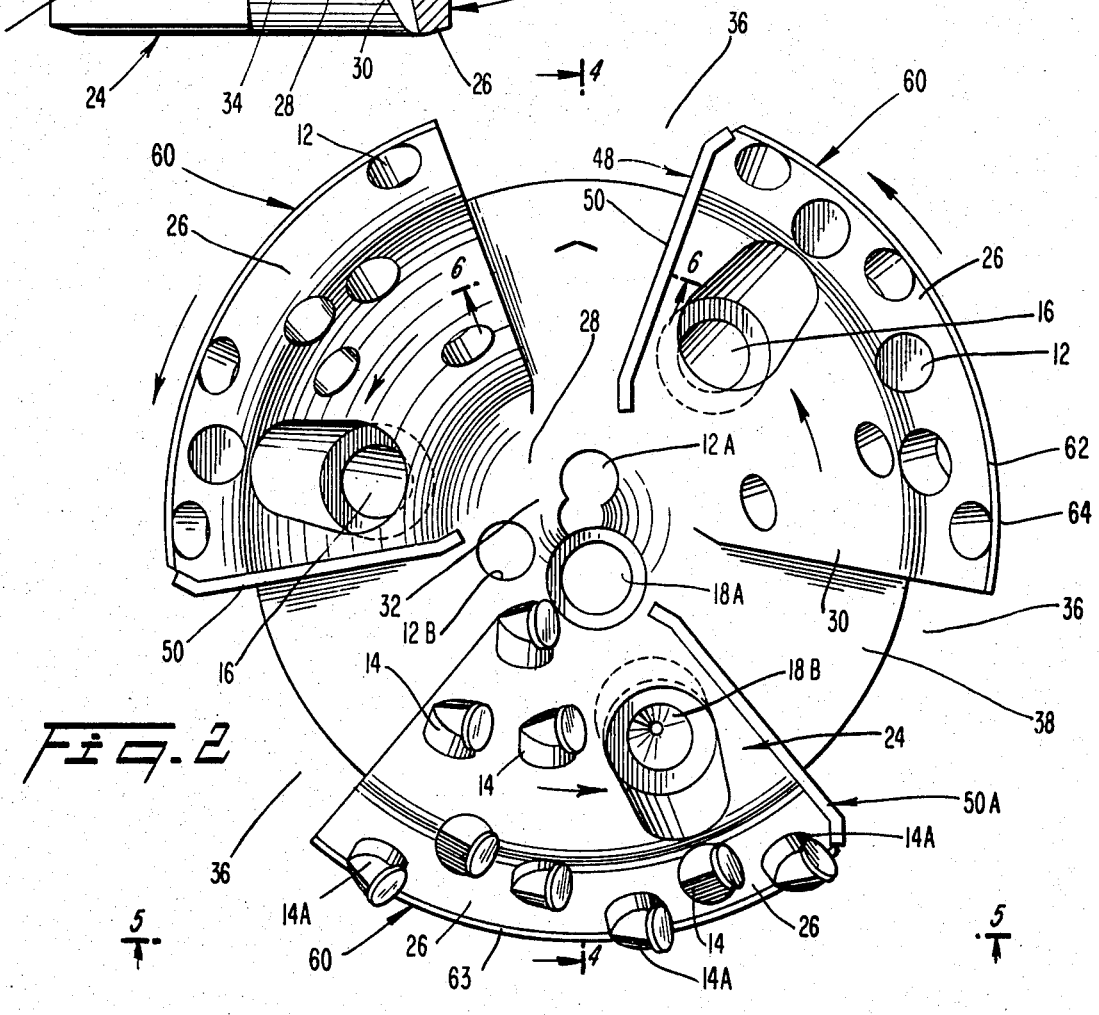
FIG. 2 is an end view of the drill bit, depicting the series of holes for receiving cutter elements and nozzles; some of the holes remaining empty in FIG. 2 and the remaining holes being depicted as containing nozzles and cutter elements.

Depicted in FIGS. 1 and 2 is a rotary drill bit 10 mounted at the end of a drill stem 11. A plurality of small bores 12 (FIG. 2) are formed in the drill bit body which are adapted to receive cutter elements 14 (FIG. 3). The cutter elements 14 may comprise polycrystalline diamond studs which are conventional or of the type disclosed in Daniels et al U.S. Pat. No. 4,156,329, and Rowley et al U.S. Pat. No. 4,073,354.

A plurality of larger bores 16 are provided in the drill bit for the reception of nozzles 18 for discharging jets of drilling fluid. The drilling fluid is conducted to the nozzles 18 through a passage 20 in the drill stem 11 and drill bit 10 which communicates with passages 22 in the drill bit. The jet streams aid in the cutting of the formation, cooling of the drill bit cutters, and carrying of the cuttings to the top of the borehole.

The cutting face 24 of the drill bit comprises an outer peripheral edge 26 and a central recess 28. The outer edge 26 slopes longitudinally inwardly (upwardly) and radially outwardly. The recess 28 is defined by side walls 30 which are inclined longitudinally and radially inwardly. The cutting elements 14 are positioned in the peripheral edge 26, in the side walls 30, and in a floor 32 of the recess 28. Most of the nozzles 18 are positioned in the side walls 30, but one of the nozzles 18A is positioned in the floor 32.

The floor 32 of the recess 28 is of concave configuration, the floor preferably comprising a centrally located, generally frusto-conical protuberance 34. If desired, the protuberance 34 could be of other convex shapes such as semispherical for example. Holes 12A, 12B for cutting elements (FIG. 2) are formed in the protuberance 34, and the afore-mentioned nozzle 18A is mounted in the protuberance 34.

The drill bit also includes a plurality of lateral discharge passages 36 which communciate with the central recess 28. Those passages 36 include base surfaces 38 (FIG. 4) which constitute continuations of an inclined wedge face 40 of the protuberance 34. The passages 36, preferably three in number, are equidistantly spaced around the longitudinal axis of the drill bit, i.e., at 120 degree intervals.

Each passage extends radially completely through the bit body and extends longitudinally outwardly to the peripheral edge 26 so as to form gaps in the latter.

It will be appreciated that during a cutting operation, the earth formtion is cut so as to form a conical earthen core which projects into the central recess 28. The core is fractured by the combined action of the cutting elements 14 and the convex protuberance 34, the former engaging the sides of the core and the apex 41 of the latter engaging the tip of the core. The convex shape of the surface 40 of the protuberance 34 assures that the reaction forces applied against the protuberance will be distributed around the protuberance and thus will tend to be self-balancing in the radial direction. That is, a concentration of forces at one point on the floor of the recess is avoided. As a result, protuberance 34 could be of other convex shapes as a semispherical for example. Holes 12A, 12B for cutting elements 14 (FIG. 2) are formed in the protuberance 34, and the aforementioned nozzle 18A is mounted in the protuberance 34.

The drill bit also includes a plurality of lateral discharge passages 36 which communicate with the central recess 28. Those passages 36 include base surfaces 38 (FIG. 4) which constitute continuations of an inclined wedge face 40 of the protuberance 34. The passages 36, preferably three in number, are equidistantly spaced around the longitudinal axis of the drill bit, i.e., at 120 degree intervals.

Each passage extends radially completely through the bit body and extends longitudinally outwardly to the peripheral edge 26 so as to form gaps in the latter.

It will be appreciated that during a cutting operation, the earth formation is cut so as to form a conical earthen core which projects into the central recess 28. The core is fractured by the combined action of the cutting elements 14 and the convex protuberance 34, the former engaging the sides of the core and the apex 41 of the latter engaging the tip of the core. The convex shape of the surface 40 of the protuberance 34 assures that the reaction forces applied against the protuberance will be distributed around the protuberance and thus will tend to be self-balancing in the radial direction. That is, a concentration of forces at one point on the floor of the recess is avoided. As a result, the drill bit will not be caused to deviate from its intended path of travel by unbalanced forces acting on the floor of the recess.

The cuttings are discharged from the recess through the passages 36 by the action of the surface 40 which serves as a wedge, and by flushing fluid from the nozzles 18, 18A.

Figure 6:
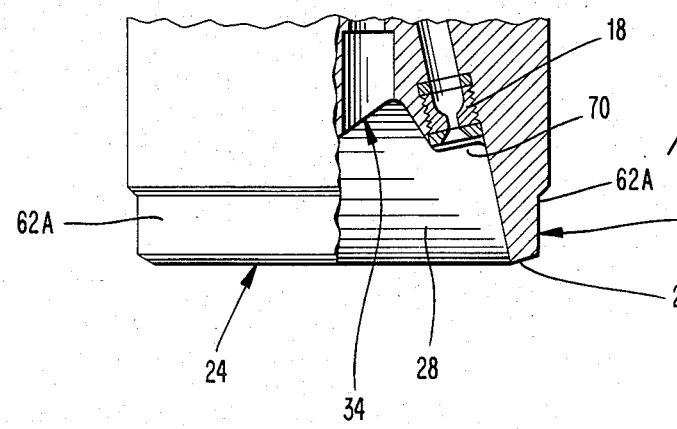
FIG. 6 is a view similar to FIG. 1 of a modified drill bit.

Disposed on the cutting face of the drill bit along the trailing edge 48 of each lateral discharge passage 36 is a ridge 50 (FIG. 6). The ridge 50 can be formed of a hard or a soft substance, as desired. For example, the ridge 50 can be formed of a hard material such as tungsten carbide or 4140 steel, or formed of a softer substance such as a soft steel (e.g., 1020 steel). The ridge 50 projects outwardly from the cutting face by a distance slightly less than that of the cutter elements 14 and extends longitudinally along the side wall of the recess and radially along the peripheral edge 26.

The ridge 50 performs two important functions. Firstly, the ridge acts to dam-up drilling fluid ejected from the adjacent trailing nozzle 18B (i.e., the nearest nozzle 18B spaced clockwise from the ridge 50 in FIG. 2). That is, in the absence of the ridge, much of the drilling fluid emanating from that nozzle would flow into the adjacent gap in the peripheral edge (i.e., the gap formed by the discharge passage) and then upwardly through the annulus. However, upon encountering the ridge 50, the fluid travel is blocked, causing the fluid to rebound and flow to the adjacent cutting elements located behind the ridge, i.e., the cutting elements spaced clockwise from the ridge 50 in FIG. 2.

As noted earlier, the ridges 50 project from the cutting face 24 by a distance less than, e.g., one-half, that of the cutter elements 14. The difference in such projecting distance is about equal to the expected penetration depth of the cutter elements. In this fashion, the ridge will essentially contact the formation, thereby minimizing the travel of fluid between the ridge and the formation.

A second important function of the ridge 50 is to act as a plow to push larger cuttings from the associated discharge passage so that such cuttings do not contact and damage the cutting elements located behind the ridge. In softer substances the ridges 50 may serve as cutter blades as well as plows.

The outer periphery of the cutting face 24 is recessed radially inwardly at 60 (FIGS. 1, 2). The recess is formed by a longitudinal side wall 62 which is of smaller radius than the outer periphery of the gauge surface 64 of the drill. The radially outermost ones 14A of the cutting elements are undercut radially by the recess 60. That is, the outer cutting elements 14A extend radially beyond the side wall 62. Also, the radially outermost portions of the outer cutting elements 14A coincide substantially with the gauge surface 64 as can be viewed in FIG. 2. The side wall 62 terminates longitudinally at a generally radial shoulder 63. The recesses 60 intersect circumferentially adjacent discharge passages 36 so as to fluidly communicate therewith. During operation of the drill, drilling fluid travels into and along the recess or gauge relief 60, thereby assuring that the drilling fluid reaches the outermost cutter elements 14A and flushes the cuttings therefrom. Consequently, the problem of cuttings building up along the outer periphery is avoided.

Figure 7:
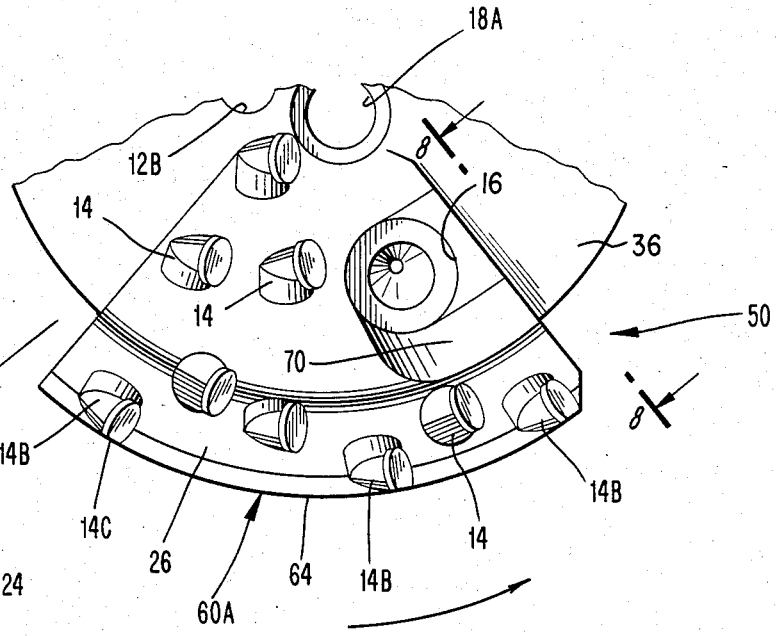
FIG. 7 is an end view of a portion of the drill bit depicted in FIG. 6.
Figure 8:
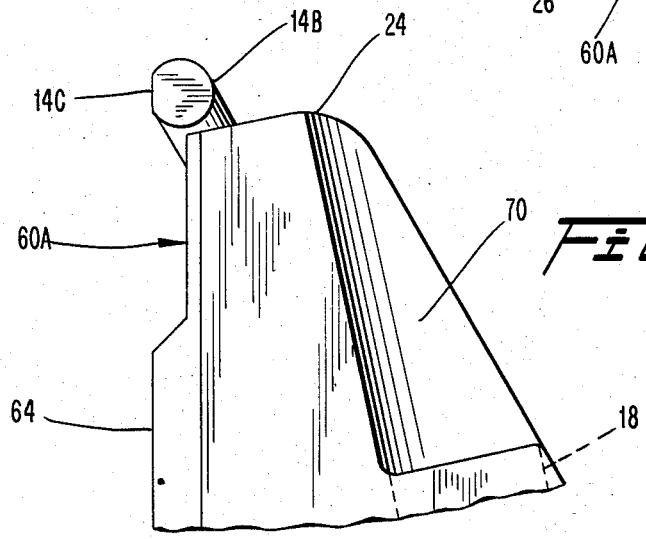
FIG. 8 is a view taken along line 8—8 in FIG. 7.

The recess 60 can be of any desired radial depth (see FIGS. 6, 7 which depict a recess 60A deeper radially than that depicted in FIG. 1). The outermost cutting elements 14B extend beyond the side walls 62A and are truncated along their outer sides to form straight edges 14B which coincide with the gauge surface 64 (see FIG. 7).

Extending from one side of an outer end of each nozzle bore 16 is a groove 70 which extends to the closest passage 36, i.e., preferably to the closest one of the trailing edges 48. If a ridge 50 is provided at that edge 48, the groove 70 would be cut through the ridge 50. Such a groove 70 acts as a relief for chunks which are of a size rendering them capable of becoming lodged within the bore 16. In such an event, the nozzle fluid could be deflected back against the drilling face, whereupon the drilling face could become cavitated. Instead, those chunks are guided to the discharge passage 36 along the groove 70. If desired, the groove could become progressively widened as it approaches the edge 48. It will be appreciated that the grooves 70 can be of various shapes and sizes.

IN OPERATION, the drill bit is rotated while simultaneously advanced into an earth formation. As the cutting operation progresses an earthen core is formed which is disposed within the recess 28. The sides of the core are gradually fractured by the cutter elements 14 disposed within the recess, and the tip of the earthen core is fractured by the cutter elements disposed in the floor of the recess, as well as by the convex protuberance 34. Engagement between the core and the protuberance is such as to establish generally radially balanced forces on the drill bit whereby the drill bit is not diverted from its intended path of travel.

The convex protuberance 34 deflects the cuttings laterally outwardly through the discharge passages 36. Ejection of larger chunks through the discharge passages is aided by the ridges 50 which act as plows to push the chunks along.

The ridges 50 also serve to block the escape of drilling fluid from the nozzles 18. Instead, that fluid rebounds rearwardly and flows across the cutter elements disposed behind the respective ridges in order to flush and cool those cutter elements.

The presence of the recesses 60, 60A assure that the drilling fluid will reach the outer periphery of the drilling face to prevent a build-up of cuttings in that region. Also, any cuttings which are of a size and configuration to become lodged within the outer ends of the nozzle bores 16 will tend to be guided to the nearest passage 36 by the guide grooves 70.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A rotary drill bit for cutting in earth formations, comprising:

a bit body including a cutting face having an outer peripheral edge and a central recess extending longitudinally inwardly from said peripheral edge, a plurality of bores formed in said cutting face and containing nozzles for emitting drilling fluid under pressure, a plurality of cutter elements, some of which being mounted in said peripheral edge, and others of which being mounted in said recess to fracture an earthen core formed as the drill cuts through the formation, said cutter elements including cutting faces facing in a direction defining a direction of rotation of said drill bit, a plurality of lateral discharge passages formed in said body, said passages extending radially through said body from said recess and extending longitudinally to said peripheral edge to form circumferential interruptions in said peripheral edge, a convex protrusion disposed centrally at a longitudinally inner end of said recess for deflecting cuttings to said lateral discharge passages, said cutting face including a groove extending in said direction of rotation from one side of an outer end of each said bores and terminating at the nearest said discharge passage for conducting cuttings from said bore to that passage.

2. A rotary drill bit according to claim 1 wherein said outer peripheral edge of said cutting face being radially recessed relative to said gauge surface by radial recesses which radially undercut portions of the radially outermost ones of said cutter elements to accommodate the flow of drilling fluid around said outermost cutting elements and thereby assure that the drilling fluid flushes cuttings thereform.

3. A rotary drill bit according to claim 2, wherein said recesses each intersect circumferentially adjacent ones of said discharge passages.

4. A rotary drill bit according to claim 2, wherein said recesses are each formed by a substantially longitudinally extending side wall situated radially inwardly of radially outermost portions of said radially outermost cutter elements.

5. A rotary drill bit according to claim 4, wherein said radially outermost cutter elements each define a substantially straight, longitudinally extending radially outermost cutting edge portion disposed in substantial longitudinal alignment with said gauge surface.

* * * * *